US012385245B2

(12) United States Patent
Carlson et al.

(10) Patent No.: US 12,385,245 B2
(45) Date of Patent: Aug. 12, 2025

(54) HEIGHT ADJUSTABLE TWO-PART HANGER WITH BACK PLATE

(71) Applicant: OMG Building Products LLC, Agawam, MA (US)

(72) Inventors: Logan Carlson, Wilbraham, MA (US); Jonathan W. Dezielle, Agawam, MA (US); Timothy F. Gillis, Florence, MA (US)

(73) Assignee: OMG Building Products LLC, Agawam, MA (US)

( * ) Notice: Subject to any disclaimer, the term of this patent is extended or adjusted under 35 U.S.C. 154(b) by 173 days.

(21) Appl. No.: 18/006,947

(22) PCT Filed: Jul. 16, 2021

(86) PCT No.: PCT/US2021/041986
§ 371 (c)(1),
(2) Date: Jan. 26, 2023

(87) PCT Pub. No.: WO2022/031421
PCT Pub. Date: Feb. 10, 2022

(65) Prior Publication Data

US 2023/0265647 A1 Aug. 24, 2023

Related U.S. Application Data

(60) Provisional application No. 63/060,168, filed on Aug. 3, 2020.

(51) Int. Cl.
*E04B 1/26* (2006.01)

(52) U.S. Cl.
CPC ..... *E04B 1/2612* (2013.01)

(58) Field of Classification Search
CPC ..... E04B 1/2612; E04B 1/2608; E04B 1/26; E04B 1/19; E04B 1/18
See application file for complete search history.

(56) References Cited

U.S. PATENT DOCUMENTS 2,202,096 A 5/1940 Dell et al.
3,954,248 A 5/1976 Barber
(Continued)

FOREIGN PATENT DOCUMENTS

GB 2316103 A 2/1998

OTHER PUBLICATIONS

International Search Report and Written Opinion mailed Nov. 9, 2021 for International Patent Application No. PCT/US2021/041986.

*Primary Examiner* — Chi Q Nguyen
(74) *Attorney, Agent, or Firm* — Alix, Yale & Ristas, LLP

(57) ABSTRACT

A hanger for supporting an elongate beam in a building structure has beam support member with a right side spaced from a left side with a support web extending therebetween at a bottom end. The right side, left side and support web define a beam receipt channel. A beam adjustment member is positioned at least partially within the channel proximate the web and in rotational or pivotal relationship with the beam support member. The beam support member may include a series of vertically spaced apart slots or notches for engagement with one or more notches or slots in a back plate. The back plate is separately attachable to a building support member and the beam support member is attachable to the back plate at multiple different vertical positions.

20 Claims, 15 Drawing Sheets

(56) References Cited

U.S. PATENT DOCUMENTS

| | | | | |
|---|---|---|---|---|
| 4,124,962 | A * | 11/1978 | Lancelot, III | E04B 1/2612 52/702 |
| 4,223,866 | A * | 9/1980 | Black | E04G 17/18 249/211 |
| 9,206,594 | B1 * | 12/2015 | Grevious | F16B 7/0486 |
| 9,347,213 | B1 * | 5/2016 | Zhang | E04B 1/388 |
| 9,637,911 | B2 * | 5/2017 | Doupe | E04B 1/2604 |
| 10,179,992 | B2 * | 1/2019 | Brekke | E04B 1/2612 |
| 10,233,632 | B1 * | 3/2019 | Wokutch | E04B 1/2608 |
| 11,118,727 | B2 * | 9/2021 | McKechnie | F16M 13/02 |
| 11,680,400 | B2 * | 6/2023 | Espinosa | E04B 1/4107 52/295 |
| 11,773,582 | B2 * | 10/2023 | Dicaire | E04B 1/2612 52/704 |
| 2002/0078656 | A1 * | 6/2002 | Leek | E04B 1/2612 52/698 |
| 2009/0113839 | A1 * | 5/2009 | Carr | E04B 1/2612 52/712 |
| 2014/0099050 | A1 * | 4/2014 | Hauk | B21D 53/10 384/276 |
| 2014/0144098 | A1 | 5/2014 | Nicholls et al. | |
| 2014/0182236 | A1 | 7/2014 | Doupe et al. | |
| 2016/0002912 | A1 | 1/2016 | Doupe et al. | |

* cited by examiner

HEIGHT ADJUSTABLE TWO-PART HANGER WITH BACK PLATE

BACKGROUND

This disclosure relates generally to the field of building construction hangers, more particularly to a hanger for supporting a beam, such as a joist, relative to a building support member (i.e., ledger), and more particularly a height adjustable two-part joist hanger with a back plate and/or a fine height adjustment cam.

In construction and building fields, hangers are common for assisting in the connection of one building member to another, such as an elongate joist to a rear support member, such as a ledger. Hangers are often formed of a strong metal like steel cut and bent to include numerous sides and surfaces used for attaching to a support member and beam, and holding and supporting the beam.

One common type of such beam is a deck or floor joist used as a substructure to support an overlying deck or floor structure. Deck joists can attach to an end support member, usually a ledger on a side of a building, and extend substantially perpendicular therefrom at a desired height, with all of the joists substantially parallel and at the same height as the other joists. A joist hanger is used as an intermediate member to support the joist and attach the joist to the support member.

A common problem associated with building materials, including beams, is that lumber is not always sized completely accurately and consistently. The height of beams can thus vary from one another by as much as 0.5 inches simply due to common production deviations or shrinkage of the wooden materials due to drying. This phenomenon can cause inconsistencies and integrity issues with building structures. Thus, it would be useful to provide a hanger with capabilities to adjust the height of a beam that it supports and attaches to a building support member.

SUMMARY

In one embodiment, a hanger for supporting an elongate beam in a building structure comprises a right side panel and a left side panel spaced from one another, a support web and a height adjustment member. The support web extends between the right side panel and left side panel and defines a beam receipt channel therebetween. The height adjustment member is positioned within the channel proximate the support web. When a beam is positioned within the channel resting on the height adjustment member in a first position relative to the web, the height adjustment member is movable, thereby moving the beam to a different second position relative to the web.

In another embodiment, a hanger for supporting an elongate beam in a building structure comprises a beam support member and a height adjustment member. The beam support member comprises a right side panel and a substantially parallel left side panel spaced from the right side panel with a support web extending therebetween. The right side panel, left side panel and support web define a beam receipt channel. The height adjustment member extends laterally within the channel and is rotatably engaged with the right side panel and left side panel. The height adjustment member additionally includes an intermediate cam positioned laterally between the left side panel and right side panel. When a beam is positioned within the channel resting on one or both of the height adjustment member and the support web in a first vertical position, the height adjustment member is rotatable to adjust the beam to a second vertical position.

In yet another embodiment, a hanger for supporting an elongate beam in a building structure comprises a beam support member and a beam adjustment member. The beam support member has a channel defined between a first lateral side wall, second lateral side wall, and bottom web extending between and connecting the first and second lateral side walls. An inner surface of the first lateral side wall is substantially parallel to an inner surface of the second lateral side wall and substantially perpendicular to an inner surface of the web. The beam support member is attachable to a building support member. The beam adjustment member is positioned at least partially within the channel and in pivotable or rotatable engagement with the beam support member. The beam support member is configured to receive an elongate beam within the channel and supported by the web upon which, pivoting or rotating the beam adjustment member initiates longitudinal movement of the beam within the channel.

In embodiments of the hanger, the height adjustment member is rotatable relative to the web.

In some embodiments, the height adjustment member includes a cam with an irregularly shaped outer surface.

In some embodiments, an axis of rotation of the height adjustment member extends through the cam of the adjustment member, and the cam comprises a nose and an opposite tail, with the axis further from the nose than from the tail.

In some embodiments, the axis of rotation of the height adjustment member extends laterally substantially perpendicular to the left side panel and the right side panel.

In some embodiments, the height adjustment member includes a lateral end portion that is positioned outside the right panel or left panel. The lateral end portion may define a mating member engageable by one or more of an individual or a tool to initiate rotation of the height adjustment member.

In some embodiments, the height adjustment member is positioned above the support web and extends laterally with one lateral end rotatably engaged with the left panel and an opposite lateral end engaged with the right panel.

In some embodiments, at least one of the lateral ends of the height adjustment member comprises an engagement member in a section outside the respective left panel or right panel.

In some embodiments, the hanger includes a base plate with a plurality of vertically spaced apart openings that is attachable to a building support. The right panel, left panel and support web form at least part of a beam support member and the beam support member includes one or more fingers engageable within one of the plurality of openings. The support member is attachable to the base plate at different relative heights in this manner.

The base plate may include a plurality of rows of vertically spaced apart openings and the beam support member may include a plurality of rows of vertically spaced fingers, each finger engageable within an opening in the base plate.

In some embodiments, the beam support member comprises at least one rear flange. The rear flange may be substantially perpendicular to the left side panel and right side panel and may define at least one opening for receipt of a fastener.

In some embodiments, the beam adjustment member includes a portion having an irregularly shaped outer surface and positioned within the channel in abutment with the beam.

In some embodiments, the beam adjustment member is pivotally or rotationally engaged with the first and second side walls.

The beam adjustment member may include an irregularly shaped round cam surface intermediate the first and second side walls.

The beam support member may be formed from a polymer material.

The beam adjustment member may be an elongate roll extending laterally at least partially within the channel and rotatably engaged with the first side wall and second side wall defining an axis of rotation, and may comprise an intermediate cam laterally between the first and second side walls. The cam may have an irregular outer surface with a nose side and a tail side with the nose side further from the axis the tail side is from the axis.

In some embodiments, a base member may comprise one or more vertically elongate grooves along the rear through which a portion of the beam support member may slide vertically. A series of vertically spaced apart teeth may be positioned laterally adjacent each vertical groove. The beam support member may be lockable to the base member in a variety of vertical positions by sliding laterally into engagement with the teeth.

The hanger may include one or more openings for receipt of a fastener to secure a beam to a rear support member.

In some embodiments, one or more fastener openings in the hanger may include a boss cover with a relatively smaller opening than the primary opening. The boss cover may be configured such that it at least partially breaks away from the main body of the hanger as a screw or fastener is driven through the hole.

Embodiments of the disclosed hanger exist with one or a combination of any of the above noted features or sub-features.

DETAILED DESCRIPTION

Figure 1:
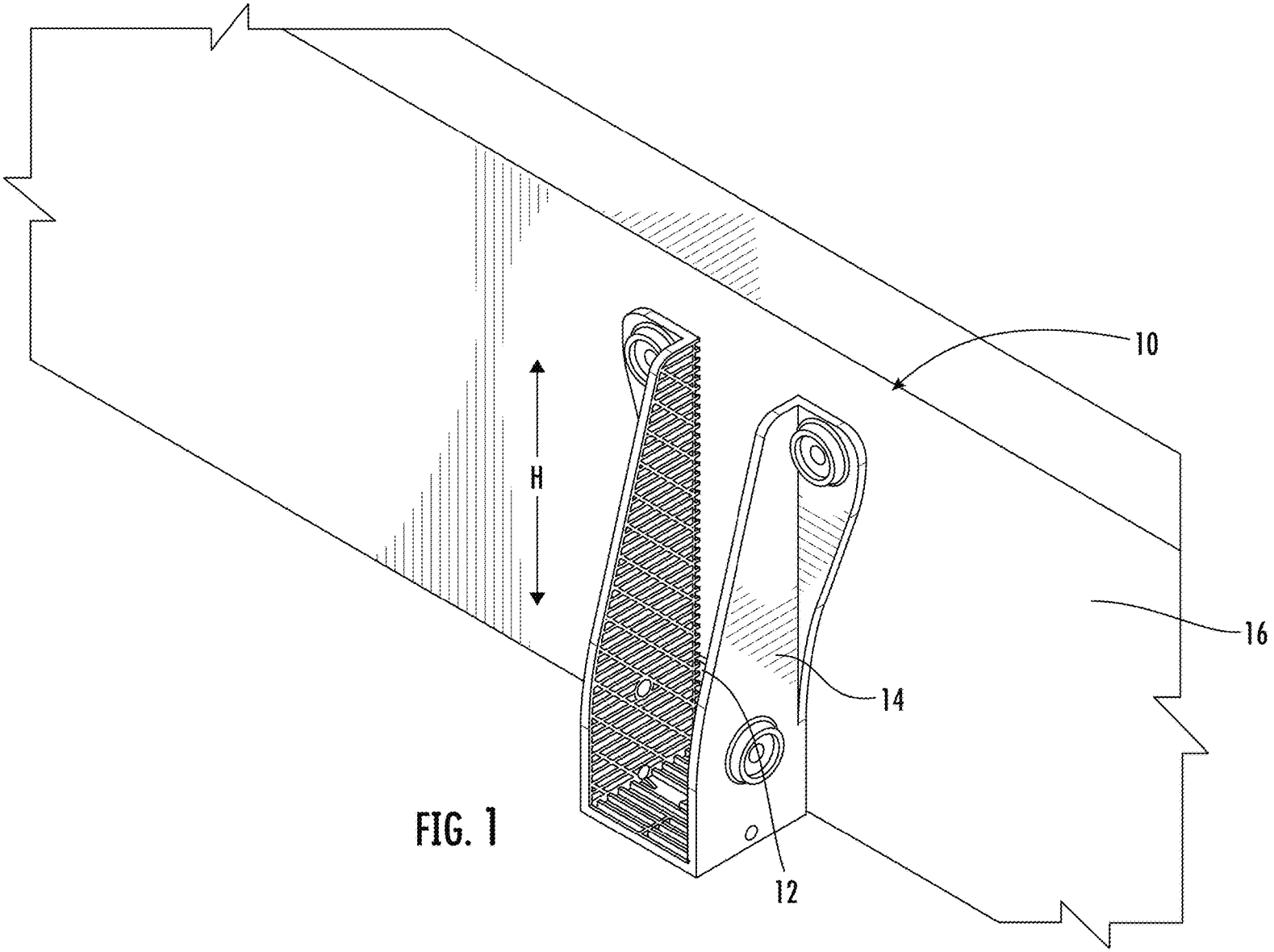
FIG. 1 shows an embodiment of a two-part height-adjustable hanger in a mated configuration.

Among the benefits and improvements disclosed herein, other objects and advantages of the disclosed embodiments will become apparent from the following wherein like numerals represent like parts throughout the several figures. Detailed embodiments of a height adjustable hanger with back plate and optional leveling cam for use in securing beams to building support members are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Additionally, the embodiments described herein are done so with primary reference to a preferred embodiment that is a hanger for attaching a joist beam to a rear ledger. However, it is understood that the embodiments are not limited as such, and the inventive concepts present in the disclosed embodiments apply to a wide variety of hangers or brackets for use in attaching elongate building support members or beams to another support member. Herein, the term "joist" is synonymous with and shall encompass a beam or elongate building member of any kind. Likewise, the term "ledger" is synonymous with and shall encompass any building support member or structure to which a beam may be attached. Further, the term "joist hanger" should be understood as a hanger for use with any type of beam, including a joist.

With reference to the drawings wherein like numerals represent like parts throughout the figures, an embodiment of a two-part adjustable joist hanger 10 is shown and described. As shown, the hanger 10 includes a base member or back plate 12 having a general flat plate shape and a beam support member 14 having a general "U" shape (see FIGS. 1 and 2) with a lower beam support web 36 extending between opposite side panels, 30 and 32. This is common exemplary configuration of a beam hanger, and importantly, the inventive embodiments are not limited as such. The joist support member 14 is configured to be connected to the base plate 12, and thus the ledger 16, at different relative heights. This height adjustability can allow installers to level beams that may have variances in size.

Figure 3:
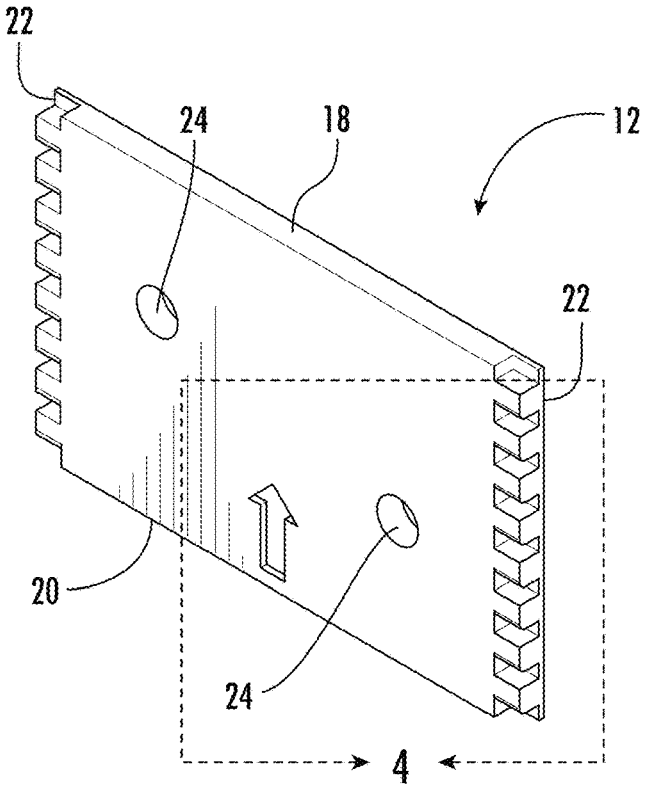
FIG. 3 is a perspective view of a back plate member of the hanger of FIG. 1.
Figure 4:
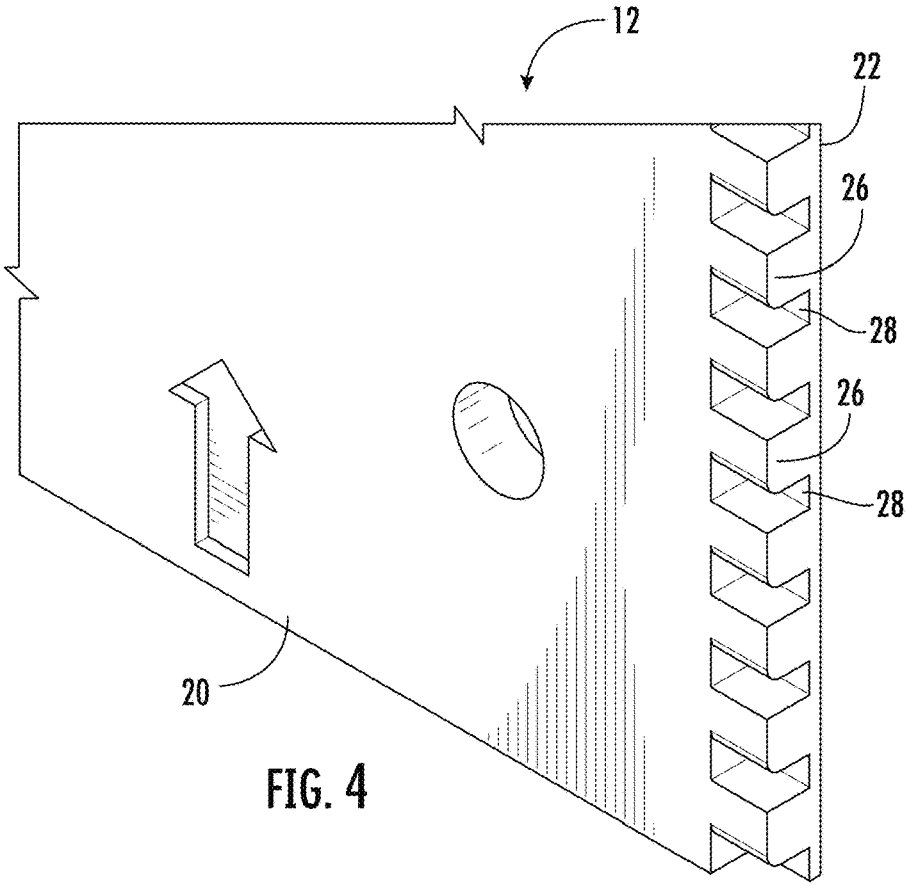
FIG. 4 is an enlarged perspective view of the back plate member of FIG. 3.

Referring now also to FIGS. 3 and 4, the base member 12 comprises a top edge 18, a bottom edge 20, and lateral edges 22 between the top edge 18 and the bottom edge 20. The base member includes mounting holes 24 sized and shaped such that a fastener can extend therethrough for securing the base member 12 to the ledger 16 (such that a back face of the base member lies securely flat against the ledger). As shown, each of the lateral edges 22 is fit with a series of vertically spaced apart ridges 26 and notches 28. The base member is a one-piece member that can be formed of a plastic material, a metal material, or any other suitable material capable of being formed such as to have the series of ridges and notches along the lateral edges.

Figure 5:
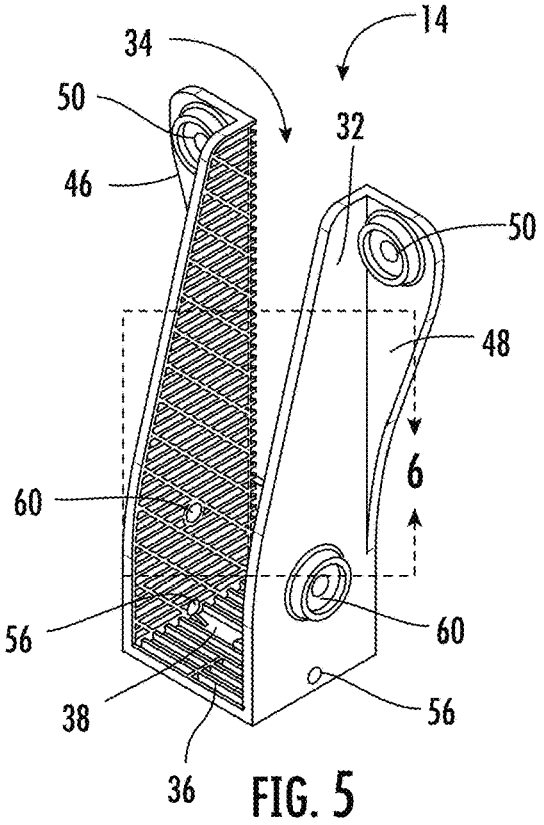
FIG. 5 is a perspective view of a support member of the hanger of FIG. 1.
Figure 6:
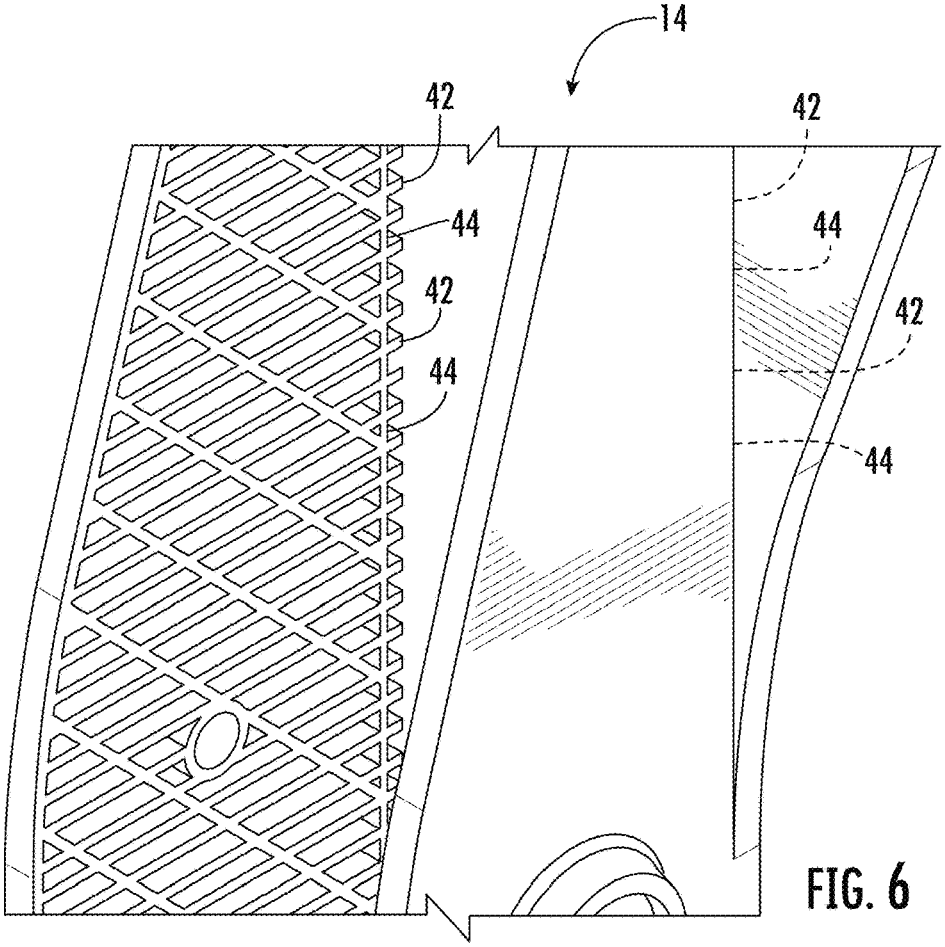
FIG. 6 is an enlarged perspective view of the support member of FIG. 5.

Referring now also to FIGS. 5 and 6, the joist support member 14 comprises a first side panel 30 and second side panel 32 that are substantially parallel to one another and define the lateral extent of a beam receiving cavity 34. The web 36 extends laterally between the first side 30 and the second side 32. As shown, the web 36 may include a flat recess 38 or similar groove configured to accommodate a rotating beam adjustment cam 40 (see FIG. 7).

Figure 2:
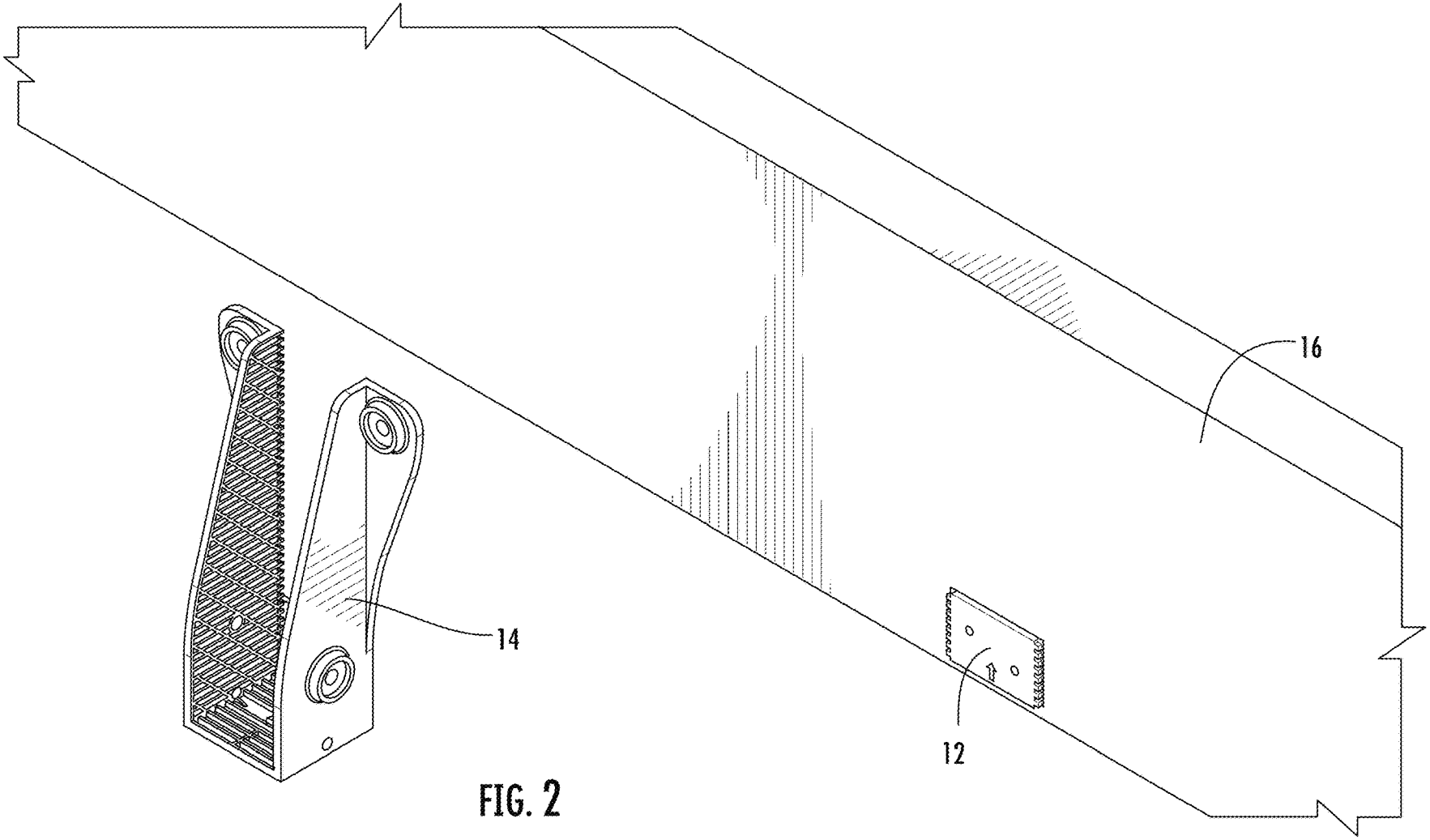
FIG. 2 is another view of the hanger of FIG. 1 (in a separated configuration)

Each of the first side panel 30 and second side panel 32 has a series of vertically spaced apart ridges 42 and notches 44 that correspond and are configured to mate with the series of ridges 26 and notches 28 of the base member 12 (see, for example, mated configuration in FIG. 1). The mateable series of cooperating ridges and notches allow for the joist support member 14 to be connected along different heights (H) relative to the base member 12 (and the ledger 16). For example, in some embodiments, the ridges (or teeth) and notches may each have a height dimension of 0.0625 inches. This height adjustment mechanism can accommodate variances in joist size. Of course, in alternate embodiments, the ridges and notches may be sized differently.

As shown, a ledger attachment flange 46, 48 extends outwardly and substantially perpendicularly from each of the sides 30, 32. The ledger attachment flanges 46, 48 provide a generally flat surface for contacting in a surface-to-surface engagement with the ledger 16, thereby providing a mounting point. Each of the flanges 46, 48 defines at least one opening 50 which allow for the sides 30, 32 to be secured to the ledger with a fastener.

The joist support member can be a one-piece member formed of a molded polymer material, a bent metal sheet, or any other suitable material capable of being formed such as to have the series of ridges and notches along the rear edges of the sides 30, 32 (in combination with the other features described above).

Figure 7:
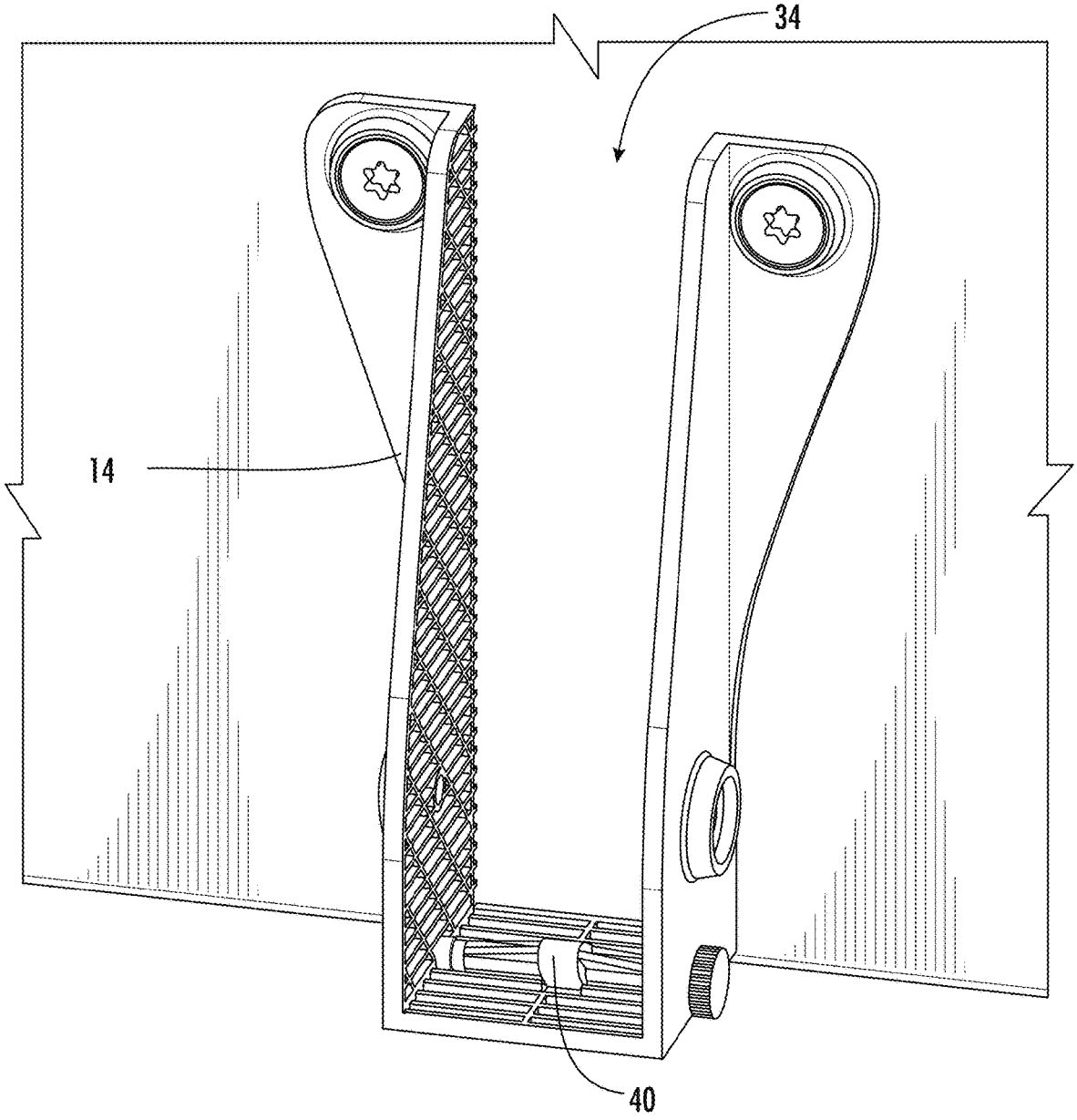
FIG. 7 is a perspective view of a portion of the hanger of FIG. 1 with a fine beam adjusting cam member installed therein.
Figure 8A:
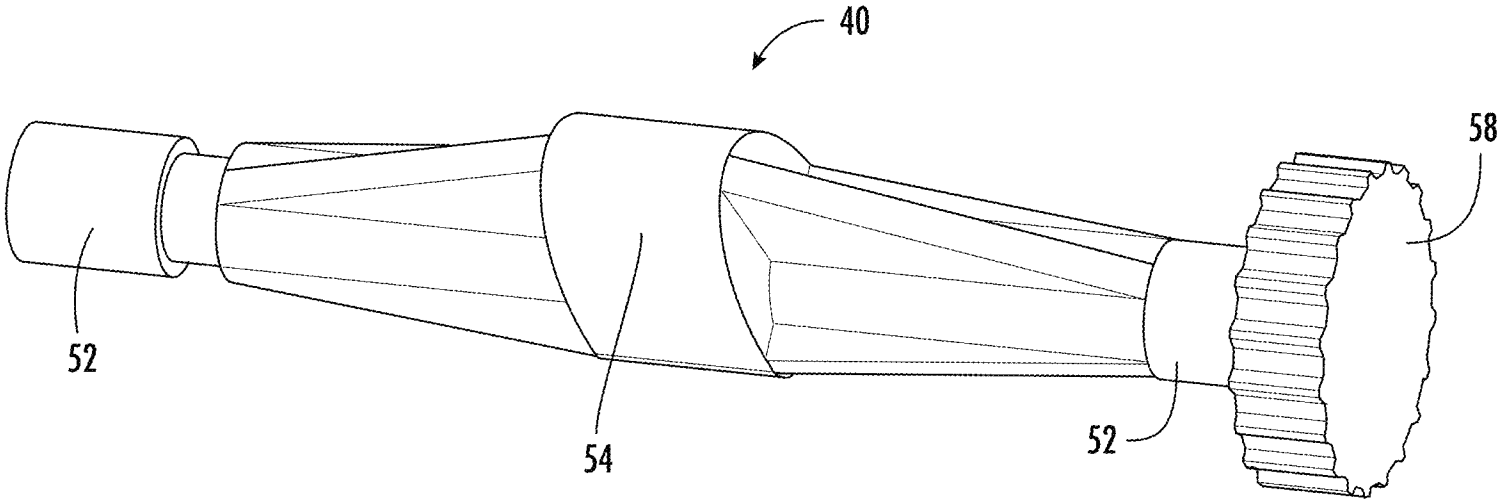
FIG. 8A-8D are different perspective views of the adjustment member shown in FIG. 7.
Figure 8B:
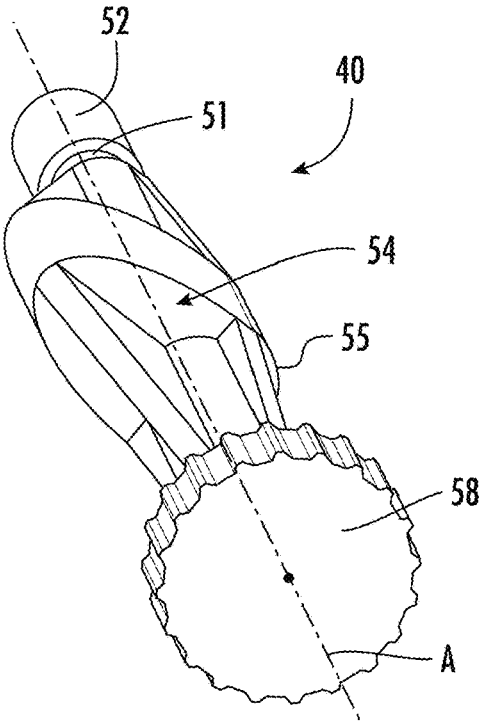
Figure 8C:
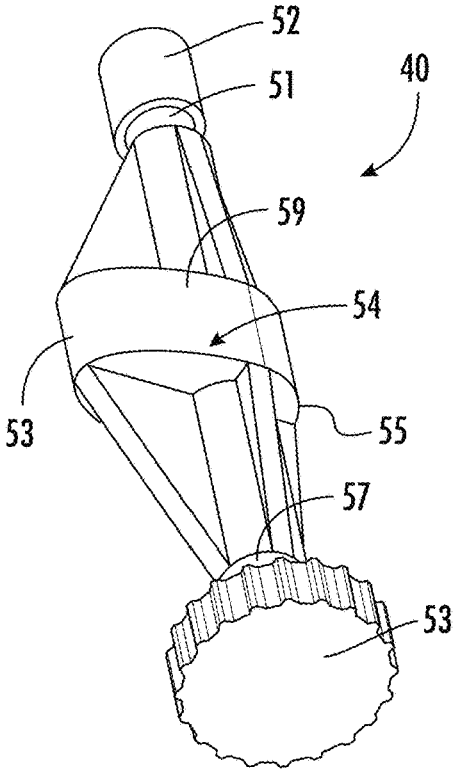
Figure 8D:
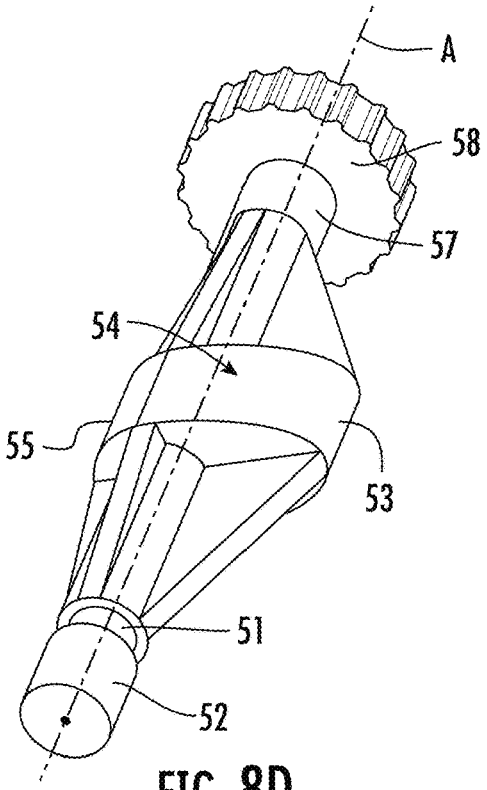
Figure 8E:
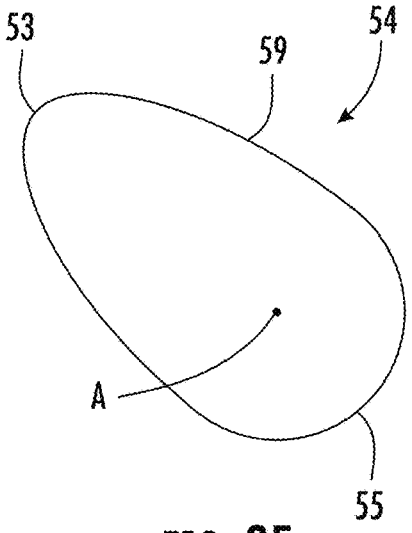
FIG. 8E is a side cross sectional view of the cam element in the adjustment member of FIGS. 8A-8D.

With reference to FIGS. 7 and 8, a beam adjustment member or cam 40 comprises opposite bearing sections 52, which may be cylindrical in shape to allow facile rotation. As shown, an irregularly shaped cam 54 is positioned between the bearing portions 52. The beam adjustment member 40 is connected between the sides 30, 32 via each bearing section 52 extending through a cooperatively shaped opening 56 and independently rotatable thereto. The irregular shape and contour of the cam lobe 54 can be appreciated with reference to FIGS. 8A-8E. As shown, the cam lobe 54 has an approximately egg-shaped cross section with a nose 53 and an opposite heel 55. The nose 53 defines an outer surface that extends radially further from the axis A of rotation defined by the cylindrical outer section 52, bearing slot 51 and knob 58 than the outer surface defined by the heel 55 with a transition ramp 59 circumferentially between the nose and heel. In operation, a beam can be installed within the cavity 34 with the cam 54 in a lowered position with the heel 55 or ramp 59 facing upward. The beam can be adjusted upward via rotating the joist adjusting member 40 (via a knob 58, for example), thereby providing an upward force on the beam as the cam 54 rotationally travels toward a position with the nose 53. The joist adjusting member (or "flipper" member) is configured to allow for height adjustment of the joist relative to the joist support member 12, and thus relative to the ledger.

Figure 9:
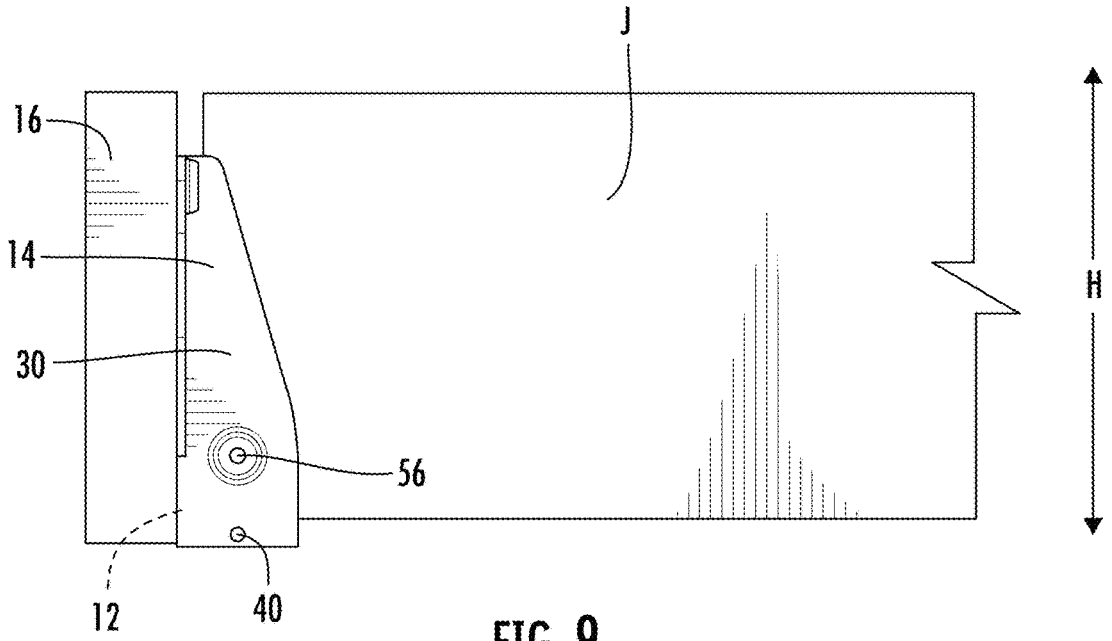
FIG. 9 shows a side view of the hanger of FIG. 1 installed holding a beam to a ledger.

With reference to FIG. 9, in a typical installation, the hanger 10 is attached to a building support member (ledger) 16 by first attaching the back plate member 12 to the ledger (via fasteners driven through the holes 24 of the back plate at a preferred height). The joist support member 14 can then be mated to the back plate (via the corresponding ridges and notches 26, 28, 42, 44) at a preferred height relative thereto and relative to the ledger. The joist support member 14 is further secured via driving fasteners through the openings 50 of the attachment flanges, 46 and 48, followed by placing a beam within the channel defined between the side panels, 30 and 32.

With the joist support member 14 secured to the ledger and the beam placed within the cavity supported by the web 36, an installer can finely adjust the height of the beam via rotating the height adjustment member 40. In the depicted embodiments, the adjustment member is rotated via the external knob 58, however, this is a non-limiting mechanism for rotating. For example, another embodiment exists with a drive connection on an exterior position of the adjustment member 40 that is mateable with a driving tool, like a screwdriver or wrench. The specific amount of potential adjustment depends on the size and configuration of the cam 54, and more specifically, the distance between the nose 53 and the axis A of rotation. For example, in some embodiments, the height of the top edge of the beam can be adjusted up to 0.5 inches. Once the beam is positioned at the preferred height, it can be fixed in position via fasteners through side holes 60. Although not depicted in FIGS. 1-9, the support member 14 typically includes one or more obliquely angled fastener guides with holes through the side panels, 30 and 32. These oblique guides are vertically offset from one another, and positioned and configured to guide fasteners driven therethrough to form a toenail connection between the beam, hanger and ledger and robustly securing the beam that complies with relevant building code.

Notably, the adjustment member 40 is not limited to use within a hanger having the specific features of the hanger 10. The rotating adjustment member 40 with irregularly shaped cam 54 can be incorporated into any style of beam hanger, including any styles of hangers known in the art and/or on the market.

In other embodiments of the disclosed hanger, the adjustment member 40 is omitted and the beam rests directly on the web 36 of the joist support member 14 (with height adjustment achieved solely by aligning the ridges and notches 42, 44 of the joist support member 14 with the ridges and notches 26, 28 of the back plate member 12 at the desired height). In the same manner as described above, once the top edge of the joist J is positioned at a preferred height, the beam can be fixed at the height (H) via driving fasteners through openings 60 and obliquely extending toenail guides.

Figure 10:
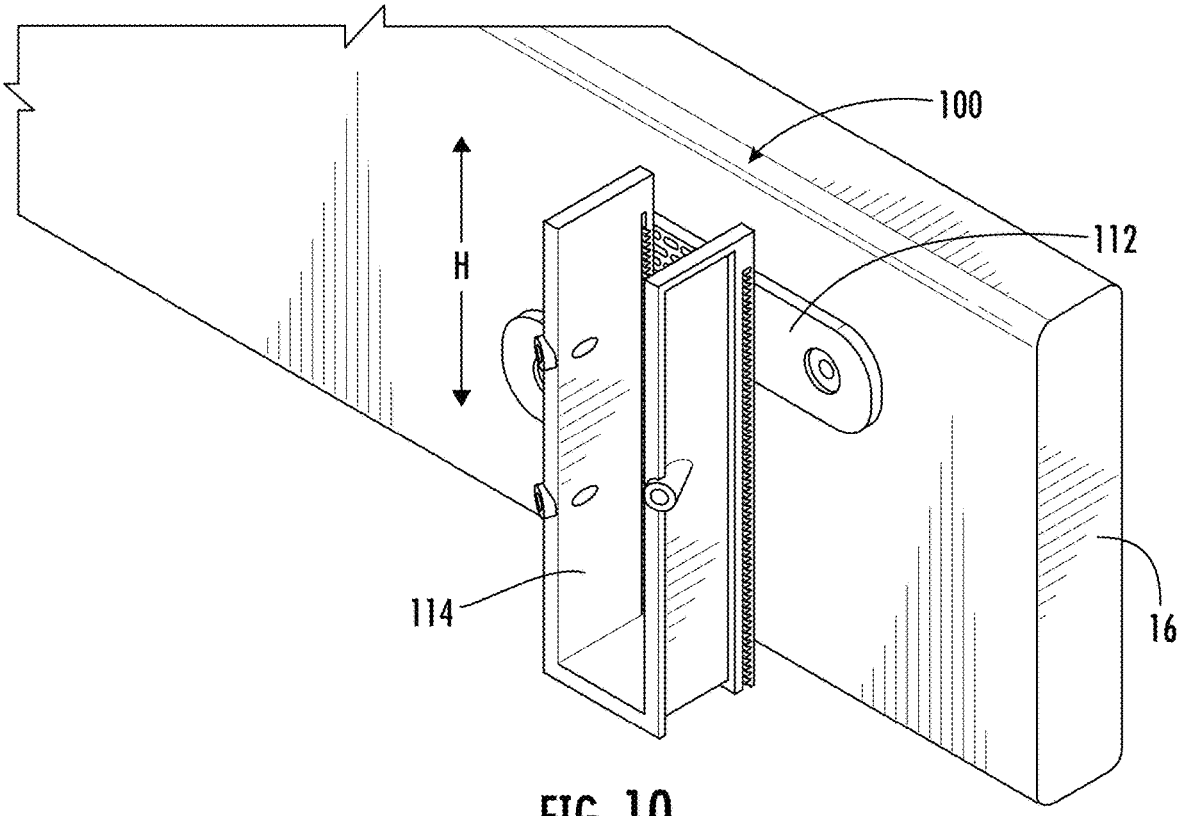
FIG. 10 shows another embodiment of a height-adjustable hanger in a mated configuration.
Figure 11:
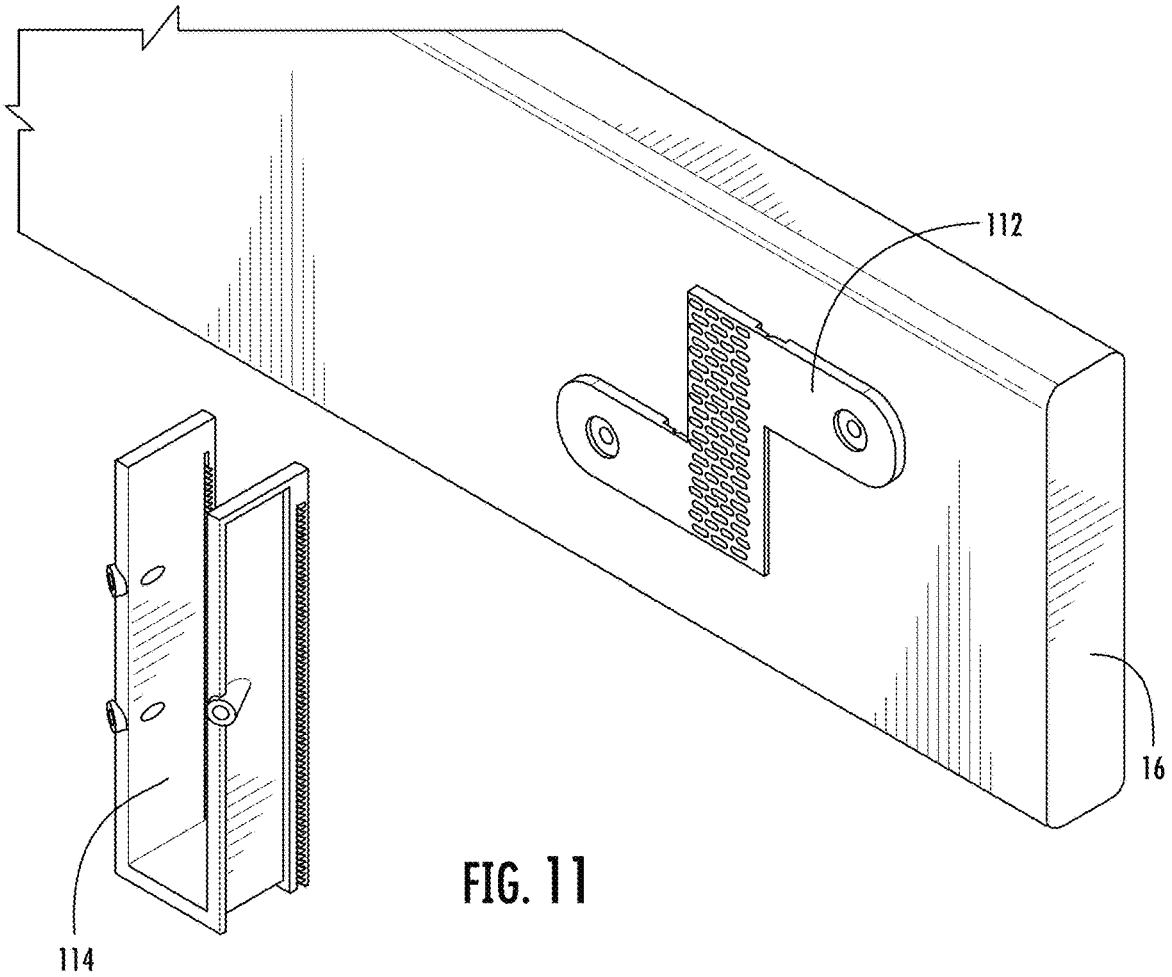
FIG. 11 is another view of the hanger of FIG. 10 (in a separated configuration)
Figure 12:
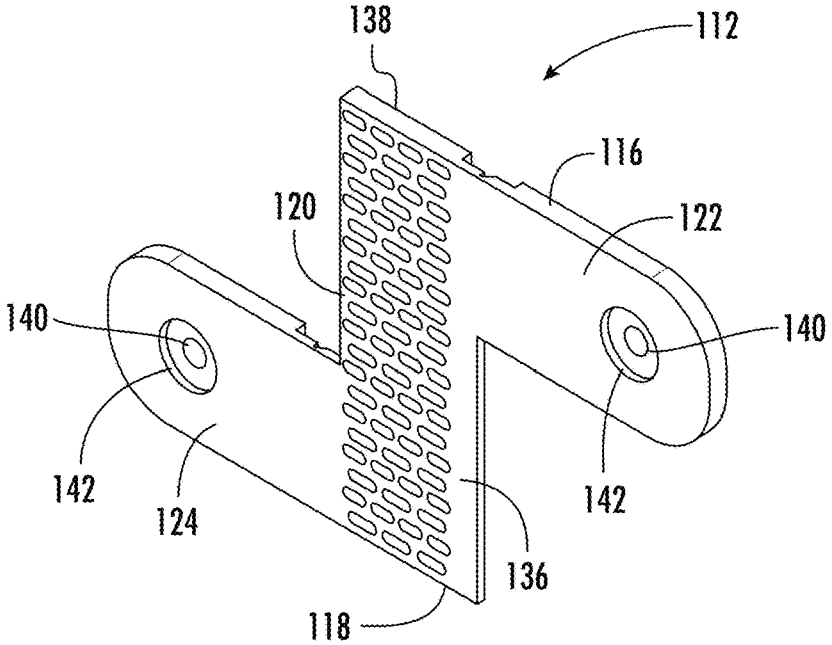
FIG. 12 is a perspective view of a back plate member of the hanger of FIG. 10.
Figure 13:
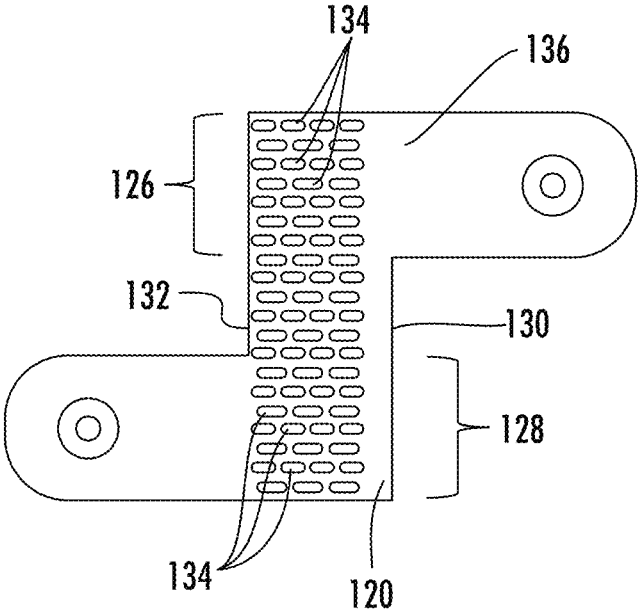
FIG. 13 is a front side view of the back plate member of the hanger of FIG. 10.

With reference now to FIGS. 10-24, there is shown another embodiment of a two-part height adjustable hanger 100. Similar to the two-part joist hanger 10 (shown in FIGS. 1-9), the two-part joist hanger 100 comprises a base (or back plate) member 112 and a joist support member 114. The base member 112 has a general "S" shape and the joist support member 114 has a general "U" shape (see FIGS. 10 and 11). The joist support member 114 is configured to be connected along different heights relative to the base member 112 (and the ledger 16). Similar to the embodiment of FIGS. 1-9, the height adjustability feature of the two-part joist hanger 100 can allow for variances in joist height.

Referring now also to FIGS. 12-15, the base member 112 comprises an integral one piece member having a top end 116, a bottom end 118, a central portion 120 extending between the top end 116 and the bottom end 118, and side portions 122, 124 extending from the central portion 120. The central portion 120 comprises an upper section 126 and a lower section 128.

The first side portion 122 extends from one side 130 of the central portion (proximate the upper section 126) and together with the upper section 126 of the central portion 120 forms the top end 116 of the base member 112. The second side portion 124 extends from the second opposite side 132 of the central portion (proximate the lower section 128) and together with the lower section 128 of the central portion 120 forms the bottom end 118 of the base member 112.

According to various exemplary embodiments, the central portion 120 includes a series of alternating rows comprising three and four openings 134. The openings 134 extend between a front side 136 and a back side 138 of the base member 112. However, in alternate embodiments, any suitable number or type of openings may be provided. It should further be understood that in some other alternate embodiments, the central portion 120 may not comprise any openings at all.

The base member 112 further includes mounting holes 140 at the side portions 122, 124 extending between the front side 136 and the back side 138 of the base member 112. The mounting holes 140 are sized and shaped such that a fastener can extend therethrough for securing the base member 112 to the ledger 16. According to some embodiments, a counterbore hole 142 may surround each mounting hole 140 at the front side 136, however in alternate embodiments any suitable configuration may be provided.

Figure 14:
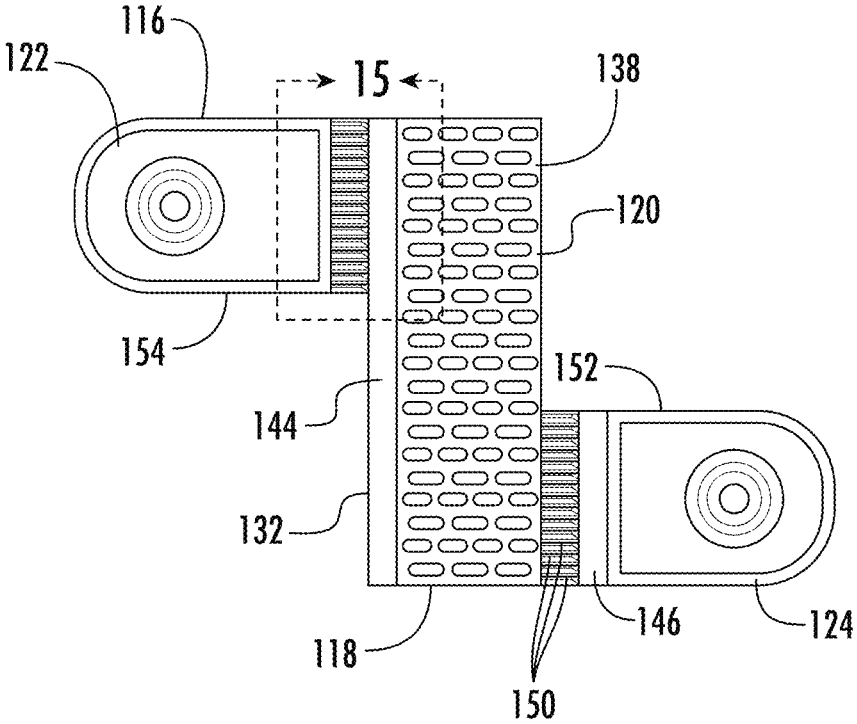
FIG. 14 is a back side view of the back plate member of the hanger of FIG. 10.
Figure 15:
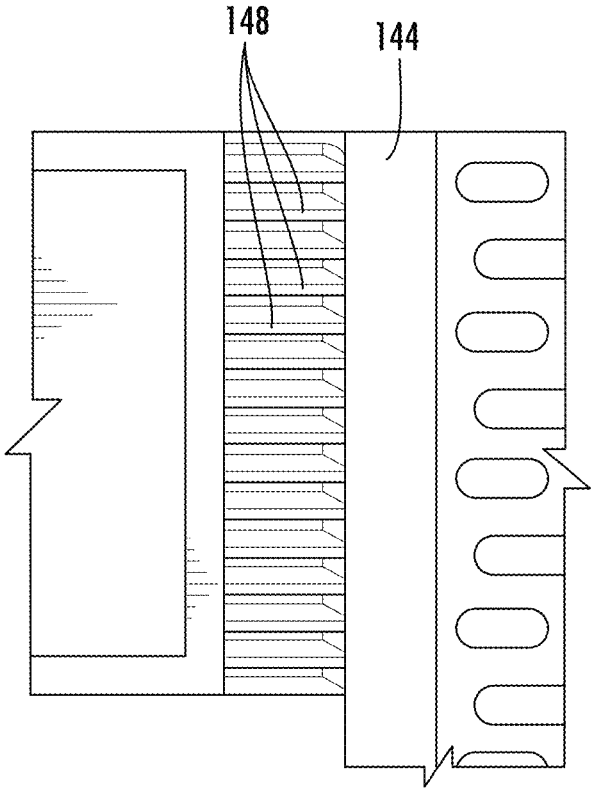
FIG. 15 is an enlarged back side view of the back plate member of FIG. 14.
Figure 16:
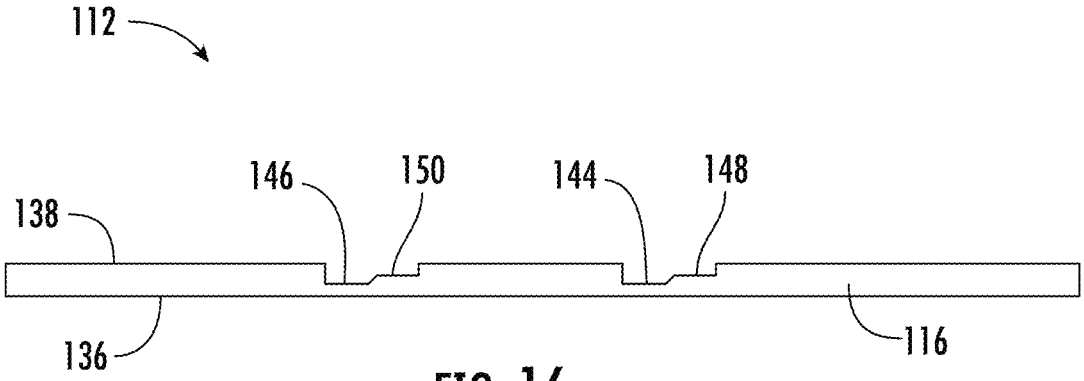
FIG. 16 is a top end view of the back plate member of the hanger of FIG. 10.
Figure 17:
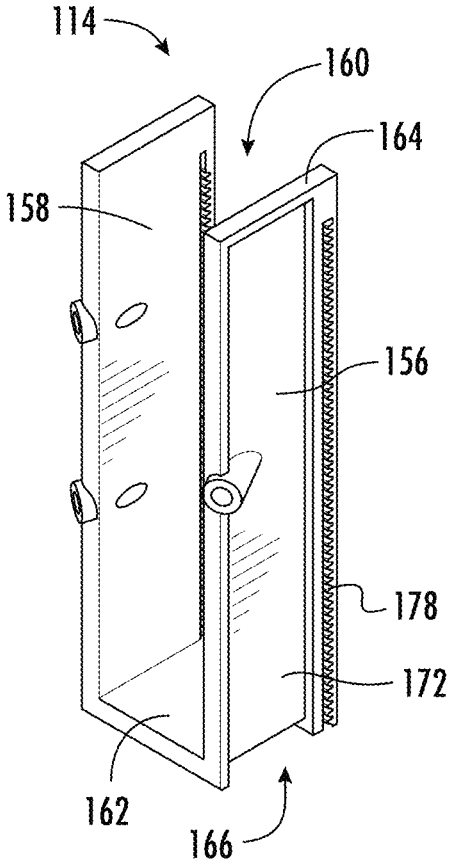
FIG. 17 is a perspective view of a beam support member of the hanger of FIG. 10.
Figure 18:
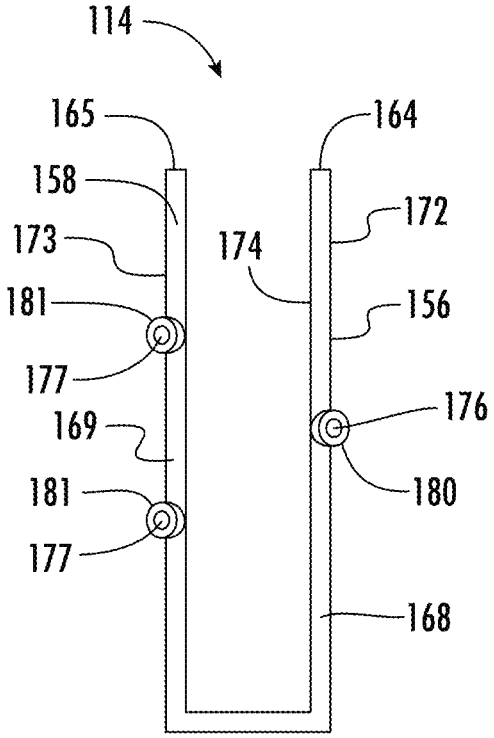
FIG. 18 is a front side view of the beam support member of the hanger of FIG. 10.
Figure 19:
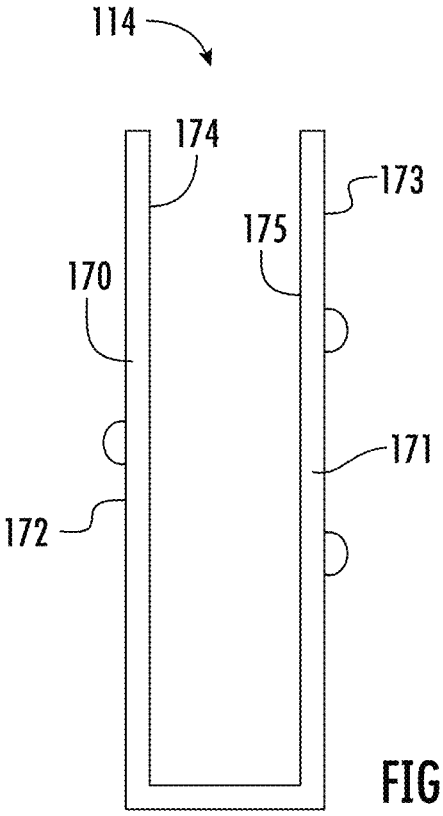
FIG. 19 is a back side view of the beam support member of the hanger of FIG. 10.
Figure 20:
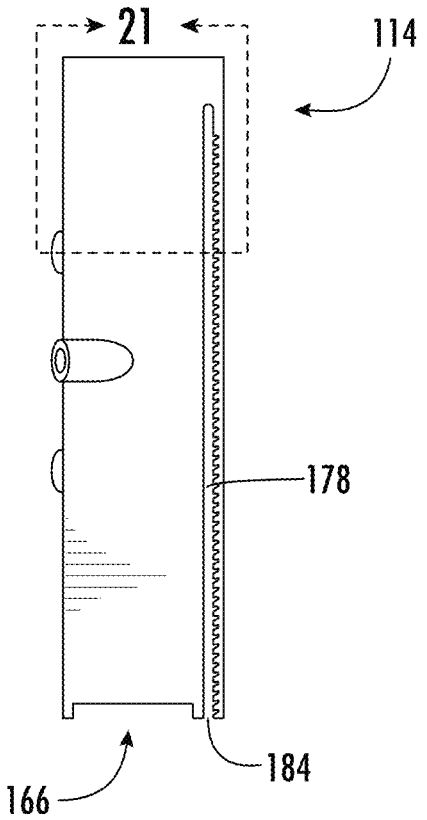
FIG. 20 is a side view of the beam support member of the hanger of FIG. 10.
Figure 21:
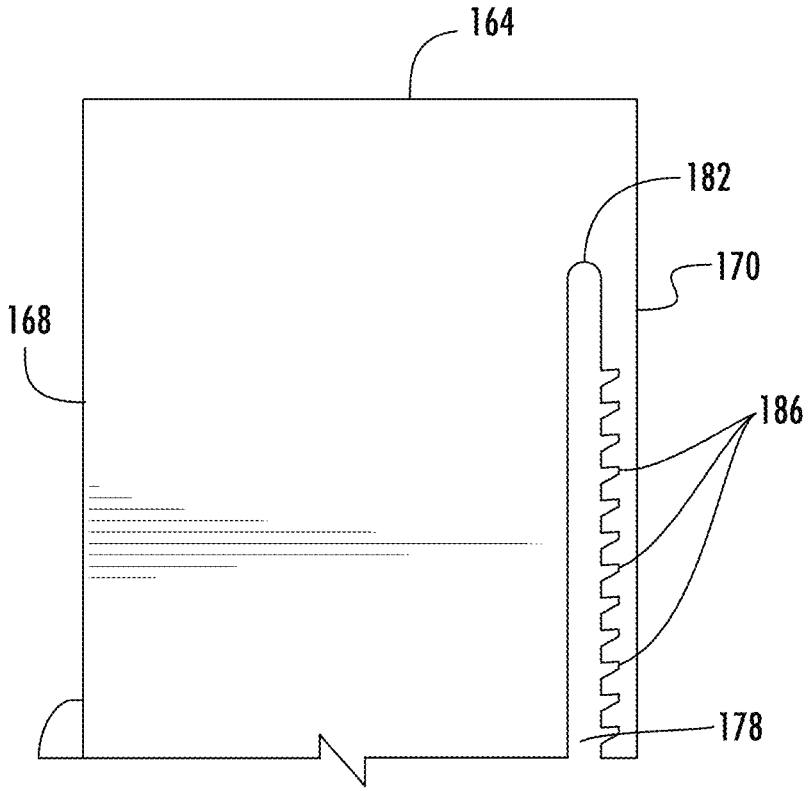
FIG. 21 is an enlarged view of a portion of the beam support member taken from the view of FIG. 20.
Figure 22:
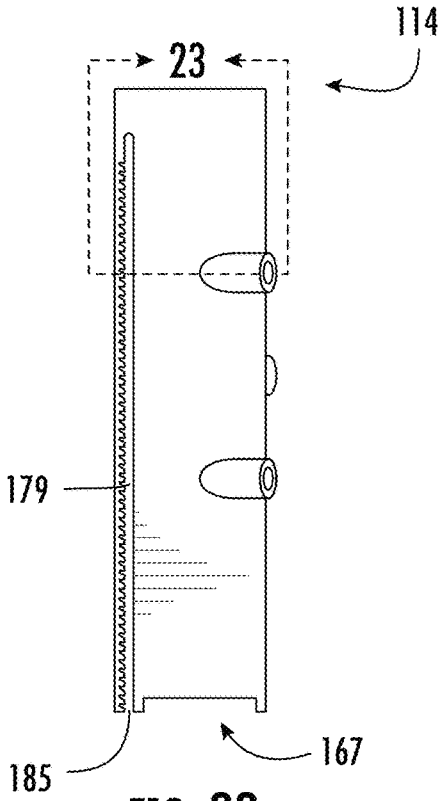
FIG. 22 is an opposite side view of the beam support member of the hanger of FIG. 10.
Figure 23:
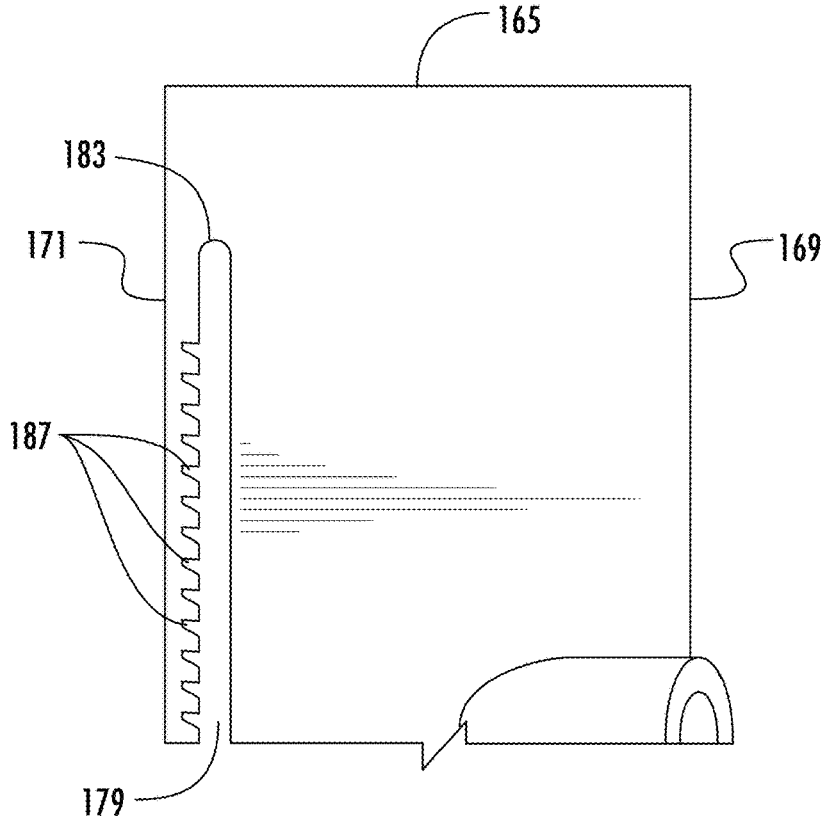
FIG. 23 is an enlarged view of a portion of the beam support member taken from the view of FIG. 22.

The base member 112 further comprises vertical grooves 144, 146 and teeth 148, 150 along the back side 138 of the base member 112 (best shown in FIGS. 14-16). In particular, the vertical groove 144 extends from the top end 116 of the base member to the bottom end 118 of the base member (and along the side 132 of the central portion 120). The vertical groove 146 extends from the bottom end 118 of the base member to a top end 152 of the side portion 124. The teeth 148 are adjacent to the vertical groove 144 and extend between the top end 116 of the base member and a bottom end 154 of the side portion 122. The teeth 150 are adjacent to the vertical groove 146 and extend between the bottom end 118 of the base member and the top end 152 of the side portion 124.

According to various exemplary embodiments, the teeth 148, 150 may each comprise a series of equally spaced teeth extending adjacent to the corresponding vertical groove 144, 146. In other alternate embodiments, any suitable spacing for the teeth may be provided. Furthermore, the base member can be formed of a plastic material, a metal material, or any other suitable material capable of being formed with the features described above.

Referring now also to FIGS. 17-23, the joist support member 114 comprises a first side panel 156 and second side panel 158 that are parallel to one another and define a joist receiving cavity 160 therebetween. A support web 162 extends laterally between the first side 156 and the second side 158.

The first side 156 has a top end 164, a bottom end 166, a front end 168, a back end 170, and lateral side faces 172, 174. The first side panel 156 further comprises at least one fastener guide 176 defining an obliquely extending hole and an open elongated slot 178 (see FIGS. 20, 21). The joist fastener opening 176 is angled relative to the first side 156 and may comprise a spacer portion 180 to accommodate the joist fastener opening 176. The open elongated slot 178 is proximate the back end 170 and extends between the top end 164 and the bottom end 166, where the closed end 182 of the open elongated slot is proximate the top end 164 and the open end 184 of the open elongated slot 178 is proximate the bottom end 166. The surface of the slot facing the front end 168 comprises a series of equally spaced grooves 186 which are sized and shaped for receiving the teeth 148 of the base member 112 (when in the "mated" configuration shown in FIG. 10).

Similar to the first side 156, the second side 158 has a top end 165, a bottom end 167, a front end 169, a back end 171, and lateral side faces 173, 175. The second side 158 further comprises toenail guides 177 with obliquely extending openings and an open elongated slot 179 at the rear (see FIGS. 22, 23). The guides 177 are angled obliquely relative to the second side 158 and configured to assist creating a toenail connection, and may each comprise a spacer portion 181 to accommodate the respective fastener. The open elongated slot 179 is proximate the back end 171 and extends between the top end 165 and the bottom end 167, where the closed end 183 of the open elongated slot is proximate the top end 165 and the open end 185 of the open elongated slot 179 is proximate the bottom end 167. Like the opposite slot, the surface of the slot in the second side 158 facing the front end 169 comprises a series of equally spaced grooves 187 which are sized and shaped for receiving the teeth 150 of the base member 112 (when in the "mated" configuration shown in FIG. 10).

Like the earlier embodiment of the hanger 10, the support member 114 can be a one-piece member formed of a plastic material, a metal material, or any other suitable material capable of being formed such as to have the slots 178, 179 and equally spaced groves 186, 187 (in combination with the other features described above). The depicted preferred embodiment is formed of molded plastic.

The mateable teeth 148, 150 and grooves 186, 187 allow for the joist support member 114 to be connected along different heights (H) relative to the base member 112 (and the ledger 16). For example, in some embodiments, the teeth and grooves may each have a dimension (along the height H) of 0.0625 inches, for example. This height adjustability feature allows for accommodating variances in joist height and ensuring that all of the joists in a given sub-structure are installed level with one another. In alternate embodiments, the teeth and grooves may comprise any suitable dimension, greater than or less than 0.0625 inches.

Although the various exemplary embodiments above have been described in connection with the base member 112 having the teeth 148, 150 and the joist support member 114 having the grooves 186, 187, one of ordinary skill in the art will appreciate that these features are shown as exemplary configurations and any suitably shaped teeth may be provided. For example, in some embodiments, the teeth may be provided as similar to the raised ridges and notches as shown in FIGS. 1-9 however, in other alternate embodiments, any suitable type of engageable features may be provided.

Figure 24:
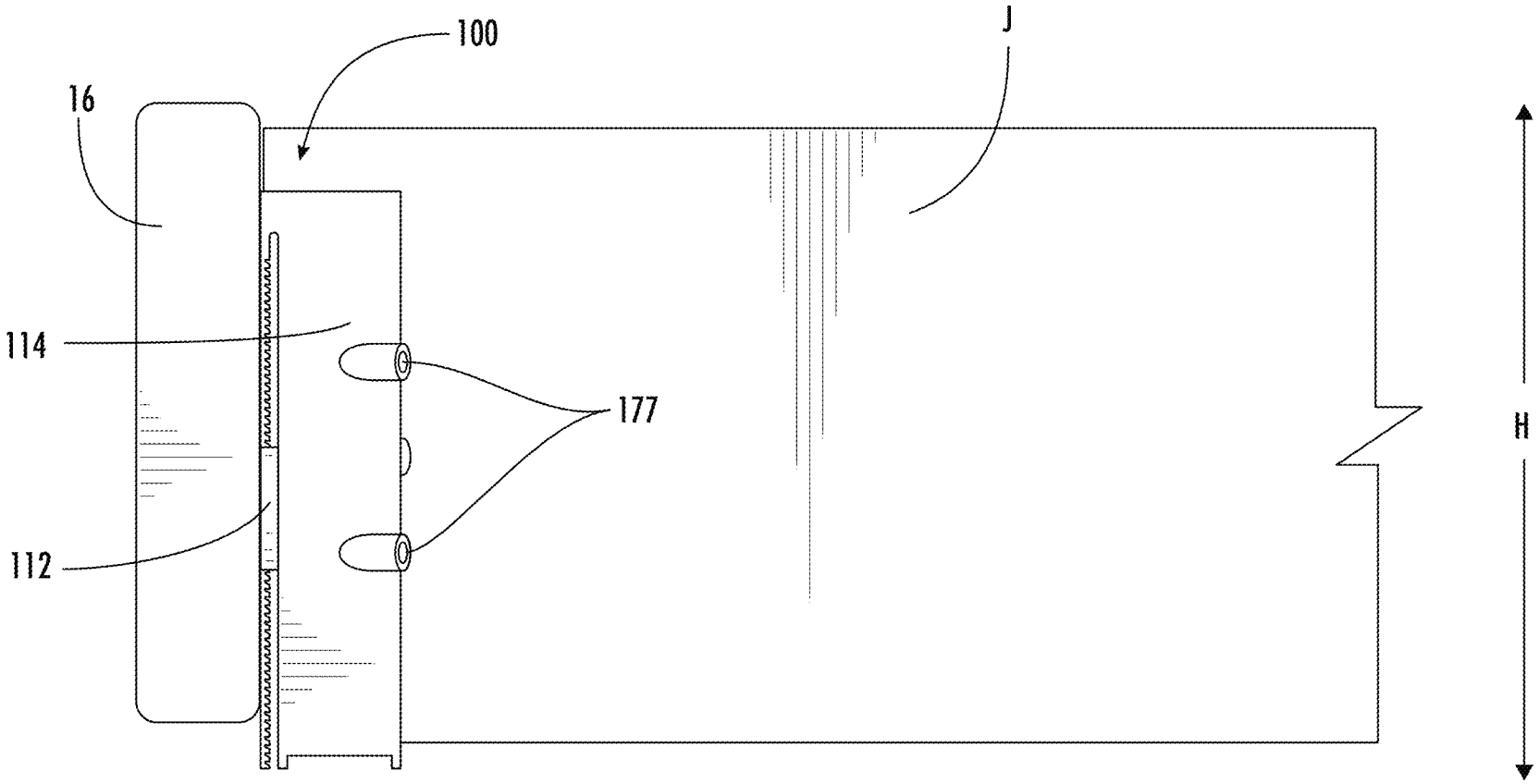
FIG. 24 shows a side view of the hanger of FIG. 10 installed holding a beam to a building support member.

With reference to FIG. 24, in a typical installation, the hanger 100 is attached to a building support member (ledger) 16 by either attaching the back plate member 112 first to the ledger 16 and then connecting the joist support member 114 to the back plate member 112, or by connecting the joist support member 114 to the back plate member 112 first and then attaching the back plate member 112 (with the connected joist support member 114) to the ledger 16.

When attaching the back plate member 112 first to the ledger 16 and then connecting the joist support member to the back plate member, the back plate member 112 is positioned at the desired location on the ledger and then attached to the ledger 16 via fasteners driven through the holes 140 of the back plate 112. The joist support member 114 can then be connected to the back plate 112 by aligning the open ends 184, 185 of the slots 178, 179 with the vertical grooves 144, 146 proximate the top end 116 of the base member and then lowering the joist support member such that the back ends 170, 171 of the sides (including the grooves 186, 187) slide and extend through the vertical grooves 144, 146.

When connecting the joist support member 114 to the back plate member 112 first and then attaching the back plate member to the ledger, the joist support member 114 is connected to the back plate 112 by aligning the open ends 184, 185 of the slots 178, 179 with the vertical grooves 144, 146 proximate the top end 116 of the base member and then lowering the joist support member such that the back ends 170, 171 of the sides (including the grooves 186, 187) slide and extend through the vertical grooves 144, 146. The back plate member 112 (with the attached joist support member 114) is then positioned at the desired location on the ledger and then secured to the ledger 16 via fasteners driven through the holes 140 of the back plate 112.

Once the hanger 100 is connected to the ledger, and with the slots 178, 179 aligned with the vertical grooves 144, 146, the joist support member is free to move or slide up and down (within the constraints of the vertical grooves 144, 146). When the installer reaches the desired position of the joist support member 114 relative to the back plate member 112, the installer can slide the joist support member laterally (to the right in the drawings), to engage the grooves 186, 187 of the joist support member with the teeth 148, 150 of the base member, thereby vertically locking the support member and back plate at the desired position.

Once the joist support member is secured to the back plate member at the desired position, the joist J is then placed within the cavity 160 with its rear edge against the back plate 112 and resting on the web of the joist support member 114. An installer can then inspect the height of the top edge of the joist J for proper alignment (if needed). If the top edge of the joist J is set to the preferred height, the joist J can be fixed at the height (H) via driving fasteners through the toenail guide openings 176, 177. If the position of the joist support member relative to the back plate member does not provide a properly aligned top edge of the joist, then the installer can alter the position by sliding laterally to disengage the teeth from the grooves and sliding vertically until the desired height is achieved.

To change the position of the joist support member relative to the back plate member, the installer can move (or slide) the joist support member to the left (which disengages the grooves 186, 187 from the teeth 148, 150) such that the slots 178, 179 are aligned with the vertical grooves 144, 146 and the joist support member is free to move up/down to the desired position. When the installer reaches the desired position of the joist support member relative to the back plate member, the installer can slide the joist support member to the right, and the grooves 186, 187 of the joist support member will engage with the teeth 148, 150 of the base member (and securing the joist support member to the back plate member at the desired position). Once the top edge of the joist J is set to the preferred height, the joist J can be fixed at the height (H) via driving fasteners through toenail guide openings 176, 177.

Additionally, the embodiments of the hanger 10 and 100 can include one or more boss covers at an outer portion any of the toenail guides consistent with those disclosed in co-owned U.S. patent application Ser. No. 17/364,950 and International Patent Application No. PCT/US2021/40033. Each boss cover defines a relatively smaller opening than the primary opening of the toenail guide and is configured so that it breaks away (at least partially) from the main body of the hanger at some point as a screw is driven further through the hole and eventually into the joist and ledger, yielding an abutment between the head of the screw and the outside surface of the hanger. In this manner, the screws are driven in a repeatably precise angle and position.

Technical effects of the one or more exemplary embodiments include significant advantages over conventional joist hangers, such as providing a robust configuration where the base member has a flat plate shape with mating areas along lateral sides, the joist support member being configured to be attached to the ledger (at the top end) and configured to be attached to the back plate member (at the bottom end), the joist support member enclosing/surrounding the base member to provide a compact configuration, and the height adjusting features including the corresponding ridges and notches of the back plate member and the joist support member and the joist adjusting member.

The various exemplary embodiments help alleviate the common problem associated with decking materials where lumber is not always sized completely accurately and consistent. The height of joists can thus vary from one another by as much as 0.5 inches simply due to common production deviations or shrinkage of the wooden materials due to drying. The height adjustable features of the various exemplary embodiments allow for placing the joist in a joist hanger at a desired height so as to be at a same height with adjacent joists (and thus provide even/parallel surfaces, i.e. top surfaces of the joists, for attaching the decking).

Additionally, while several distinct embodiments of an adjustable joist hanger have been described herein, none of them are strictly limited to the exact depicted versions. Embodiments exist with a combination of features or sub-features of one embodiment with features or sub-features of another embodiment. By way of non-limiting example, an embodiment of the hanger 100 exist that includes an adjustment member like that depicted as reference numeral 40. Further, the hanger 10 may utilize a vertical slot and adjacent teeth sliding mechanism for height adjustment and locking similar to that of the hanger 100.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A hanger for supporting an elongate beam in a building structure, comprising:

a right side panel and a left side panel spaced from one another;

a support web extending between the right side panel and left side panel and defining a beam receipt channel therebetween; and a height adjustment member within the channel proximate the support web, wherein the height adjustment member is positioned above the support web and extends laterally with one lateral end rotatably engaged with the left panel and an opposite lateral end engaged with the right panel, and the height adjustment member is movable and configured to move the elongate beam from an initial first position within the channel resting on the height adjustment member to a different second position relative to the web.

2. The hanger of claim 1, wherein the height adjustment member is rotatable relative to the web.

3. The hanger of claim 1, wherein the height adjustment member includes a cam with an irregularly shaped outer surface.

4. The hanger of claim 3, wherein an axis of rotation extends through the cam and the cam comprises a nose and an opposite tail, wherein the axis is further from the nose than from the tail.

5. The hanger of claim 4, wherein the axis extends laterally substantially perpendicular to the left side panel and the right side panel.

6. The hanger of claim 5, wherein the height adjustment member includes a lateral end portion that is positioned outside the right panel or left panel, the lateral end portion defining a mating member engageable by one or more of an individual or a tool to initiate rotation of the height adjustment member.

7. The hanger of claim 1, wherein at least the right side panel, left side panel and support web are formed from a polymer.

8. A hanger for supporting an elongate beam in a building structure, comprising:

a right side panel and a left side panel spaced from one another;

a support web extending between the right side panel and left side panel and defining a beam receipt channel therebetween; and a height adjustment member within the channel proximate the support web, wherein the height adjustment member is movable and configured to move the elongate beam from an initial first position resting on the height adjustment member to a different second position relative to the web, and at least one of the lateral ends of the height adjustment member extends through either the left panel or right panel and comprises an engagement member in a section outside the respective left panel or right panel.

9. A hanger for supporting an elongate beam in a building structure, comprising:

a right side panel and a left side panel spaced from one another;

a support web extending between the right side panel and left side panel and defining a beam receipt channel therebetween; and a height adjustment member within the channel proximate the support web, and a base plate with a plurality of vertically spaced apart openings, the base plate being attachable to a building support, wherein the right panel, left panel and support web form at least part of a beam support member and the beam support member includes one or more fingers engageable within one of the plurality of openings such that the support member is attachable to the base plate at different relative heights, and the height adjustment member is movable and configured to move the elongate beam from an initial first position within the channel resting on the height adjustment member to a different second position relative to the web.

10. The hanger of claim 9, wherein the base plate includes a plurality of rows of vertically spaced apart openings and the beam support member includes a plurality of rows of vertically spaced fingers, each finger engageable within an opening in the base plate.

11. The hanger of claim 9, wherein at least the right side panel, left side panel and support web are formed from a polymer.

12. A hanger for supporting an elongate beam in a building structure, comprising:

a beam support member comprising a right side panel and a substantially parallel left side panel spaced from the right side panel with a support web extending therebetween, the right side panel, left side panel and support web defining a beam receipt channel; and a height adjustment member extending laterally within the channel and rotatably engaged with the right side panel and left side panel, the height adjustment member including an intermediate cam positioned laterally between the left side panel and right side panel, wherein the height adjustment member is rotatable and configured to adjust a height of the elongate beam from a first vertical position within the channel resting on one or both of the height adjustment member and the support web to a second vertical position.

13. The hanger of claim 12, wherein the beam support member further comprises at least one rear flange substantially perpendicular to the left side panel and right side panel and defining at least one opening for receipt of a fastener.

14. The hanger of claim 12, wherein the cam includes a nose and a tail, the nose having a surface that is further from an axis of rotation of the height adjustment member than the tail is from the axis of rotation.

15. The hanger of claim 12, wherein the height adjustment member comprises an engagement member positioned outside the channel that is engageable to initiate rotation of the height adjustment member.

16. A hanger for supporting an elongate beam in a building structure, comprising:

a beam support member with a channel defined between a first lateral side wall, second lateral side wall, and bottom web extending between and connecting the first and second lateral side walls, an inner surface of the first lateral side wall being substantially parallel to an inner surface of the second lateral side wall and substantially perpendicular to an inner surface of the web, the beam support member being attachable to a building support member; and a beam adjustment member positioned at least partially within the channel and in pivotable or rotatable engagement with the beam support member, wherein the beam adjustment member is pivotally or rotationally engaged with the first and second side walls, and the beam support member is configured to receive the elongate beam within the channel and supported by the web and pivoting or rotating the beam adjustment member initiates longitudinal movement of the beam within the channel.

17. The hanger of claim 16, wherein the beam adjustment member includes a portion having an irregularly shaped outer surface and positioned within the channel in abutment with the beam.

18. The hanger of claim 16, wherein the beam adjustment member includes an irregularly shaped round cam surface intermediate the first and second side walls.

19. The hanger of claim 16, wherein the beam support member is formed from a polymer material.

20. The hanger of claim 16, wherein the beam adjustment member is an elongate roll extending laterally at least partially within the channel and rotatably engaged with the first side wall and second side wall defining an axis of rotation, and comprises an intermediate cam laterally between the first and second side walls, the cam having an irregular outer surface with a nose side and a tail side, the nose side being further from the axis than the tail side is from the axis.

* * * * *